US009006159B2

(12) United States Patent
Schober et al.

(10) Patent No.: US 9,006,159 B2
(45) **Date of Patent: *Apr. 14, 2015**

(54) STAR POLYMER LUBRICATING COMPOSITION

(75) Inventors: Barton J. Schober, Perry, OH (US); Mark C. Davies, Belper (GB); Michael R. Sutton, Matlock (GB); Marina Baum, Chagrin Falls, OH (US); Daniel C. Visger, Mentor, OH (US); David Price, Littleover (GB); Brent R. Dohner, Concord, OH (US); Mark F. Wilkes, Hatton (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/557,718

(22) Filed: Jul. 25, 2012

(65) Prior Publication Data

US 2012/0289444 A1 Nov. 15, 2012

Related U.S. Application Data

(63) Continuation of application No. 12/297,468, filed as application No. PCT/US2007/066945 on Apr. 19, 2007, now abandoned.

(51) Int. Cl.

| | |
|---|---|
| ***C10M 145/14*** | (2006.01) |
| ***C10M 169/04*** | (2006.01) |
| ***C10M 167/00*** | (2006.01) |
| ***C10M 161/00*** | (2006.01) |

(52) U.S. Cl.

CPC ..... *C10M 167/00* (2013.01); *C10M 161/00* (2013.01); *C10M 2207/028* (2013.01); *C10M 2207/26* (2013.01); *C10M 2209/084* (2013.01); *C10M 2215/064* (2013.01); *C10M 2215/28* (2013.01); *C10M 2217/00* (2013.01); *C10M 2217/043* (2013.01); *C10M 2219/022* (2013.01); *C10M 2219/046* (2013.01); *C10M 2223/045* (2013.01); *C10N 2210/06* (2013.01); *C10N 2220/021* (2013.01); *C10N 2220/029* (2013.01); *C10N 2230/52* (2013.01); *C10N 2240/04* (2013.01); *C10N 2240/08* (2013.01); *C10N 2240/10* (2013.01)

(58) Field of Classification Search

CPC ..... C10M 167/00; C10M 161/00; C10M 2223/045; C10M 2207/028; C10M 2217/00; C10M 2219/046; C10M 2219/022; C10M 2215/064; C10M 2209/084; C01N 2220/021; C01N 2210/06; C01N 2220/029; C01N 2240/08

USPC ..... 508/186, 188, 287, 320, 421, 441, 508/452–458, 469–471

See application file for complete search history.

(56) References Cited

U.S. PATENT DOCUMENTS

| | | | | |
|---|---|---|---|---|
| 5,070,131 | A | 12/1991 | Rhodes et al. | |
| 5,490,945 | A | 2/1996 | Smith et al. | |
| 5,955,405 | A | 9/1999 | Liesen et al. | |
| 6,586,375 | B1 | 7/2003 | Gahagan et al. | |
| 2002/0019320 | A1 * | 2/2002 | Nakazato et al. | 508/159 |
| 2005/0038146 | A1 | 2/2005 | Fish, Jr. et al. | |
| 2006/0189490 | A1 * | 8/2006 | Dardin et al. | 508/469 |

FOREIGN PATENT DOCUMENTS

| | | | |
|---|---|---|---|
| EP | 0439254 | | 7/1991 |
| EP | 0449374 | | 10/1991 |
| EP | 0979834 | | 2/2000 |
| WO | 9623012 | | 8/1996 |
| WO | 9747661 | | 12/1997 |
| WO | WO 03095512 | A1 * | 11/2003 |
| WO | 2004087850 | | 10/2004 |
| WO | WO 2004087850 | A1 * | 10/2004 |

OTHER PUBLICATIONS

IUPAC Gold Book (copyright 2005-2012).*
Search Report from corresponding international application No. PCT/US2007/066945 dated Oct. 5, 2007.
Written Opinion from corresponding international application No. PCT/US2007/066945 dated Oct. 5, 2007.

* cited by examiner

*Primary Examiner* — Pamela H Weiss
(74) *Attorney, Agent, or Firm* — Teresan W. Gilbert, Esq.; David M. Shold, Esq.

(57) ABSTRACT

The invention provides a lubricating composition containing (a) 0.001 wt % to 15 wt % of a polymer with radial or star architecture; (b) an overbased detergent; (c) a dispersant; and (d) an oil of lubricating viscosity. The invention further provides a method for lubricating a mechanical device with the lubricating composition.

17 Claims, No Drawings

STAR POLYMER LUBRICATING COMPOSITION

FIELD OF INVENTION

The present invention relates to a lubricating composition containing a polymer such as a star polymer, an overbased detergent and a dispersant. The invention further provides a method for lubricating a mechanical device using the lubricating composition.

BACKGROUND OF THE INVENTION

The use of star polymers in lubricating compositions is known. The star polymers known in lubricating compositions are summarised in the prior art below.

International Application WO 04/087850 discloses lubricating compositions containing block copolymers prepared from RAFT (Reversible Addition Fragmentation Transfer) or ATRP (Atom Transfer Radical Polymerisation) polymerisation processes. The polymers have frictional properties. The block copolymer may have di-block, tri-block, multi-block, comb and/or star architecture. However, no guidance is given on methods suitable to prepare star copolymers. Also disclosed are polymers suitable for greases, motor oils, gearbox oils, turbine oils, hydraulic fluids, pump oils, heat transfer oils, insulation oils, cutting oils and cylinder oils.

U.S. Patent Application US05/038146 discloses star polymers derived from (i) a core portion comprising a polyvalent (meth)acrylic monomer, oligomer or polymer thereof or a polyvalent divinyl non-acrylic monomer, oligomer or polymer thereof; and (ii) at least two arms of polymerized alkyl (meth)acrylate ester. The polymers may be prepared by RAFT, ATRP or nitroxide mediated techniques.

International Application WO 96/23012 discloses star-branched polymers prepared from acrylic or methacrylic monomers. The polymers have a core or nucleus derived from acrylate or methacrylate esters of polyols. Further the polymers have molecular weights and other physical characteristics that make them useful for lubricating oil compositions. The star-branched polymers disclosed are prepared by anionic polymerisation techniques.

The star polymers of EP 979 834 require from 5 to 10 weight percent of a C16 to C30 alkyl(meth)acrylate and from 5 to 15 weight percent of butyl methacrylate. A viscosity index improver with a C16 to C30 alkyl(meth)acrylate monomer present at 5 weight percent or more has reduced low temperature viscosity performance because the polymer has a waxy texture.

U.S. Pat. No. 5,070,131 disclose gear oil compositions having improved shear stability index essentially consisting of gear oil, a viscosity index improver comprising a hydrogenated star polymer comprising at least four arms, the arms comprising, before hydrogenation, polymerized conjugated diolefin monomer units and the arms having a number average molecular weight within the range of 3,000 to 15,000.

None of the prior art references above disclose fully formulated lubricating compositions that simultaneously achieve acceptable viscosity index (VI), oil blend thickening capabilities, improved fuel economy, good shear stability, crankcase performance, good low temperature viscosity performance, and low viscosity modifier treatment level whilst maintaining the appropriate lubricating performance for a mechanical device, such as an internal combustion engine.

In view of the prior art it would be advantageous to have a lubricating composition containing a polymer that is capable of providing acceptable viscosity index (VI), oil blend thickening capabilities, shear stability, good low temperature viscosity performance, and low viscosity modifier treatment level whilst maintaining the appropriate lubricating performance for a mechanical device.

The present invention provides a lubricating composition capable of providing acceptable viscosity index (VI), oil blend thickening capabilities, shear stability, good low temperature viscosity performance, and low viscosity modifier treatment level whilst maintaining the appropriate lubricating performance for a mechanical device.

The prior art references, specifically WO 96/23012 and U.S. Pat. No. 5,070,131 employ anionic polymerisation techniques to prepare the polymer. Anionic polymerisation techniques are believed to involve complex processes that require systems to be substantially water-free, acid-free, oxygen-free, dry, clean, and have non-contaminated vessels. In one particular embodiment it would be advantageous to have a lubricating composition that does not require a polymer prepared with complex processes that require oxygen-free, dry, clean, non-contaminated vessels. In one embodiment the lubricating composition contains a polymer that does not require preparation by anionic polymerisation techniques.

It is also known that in internal combustion engines polymethacrylate polymers are believed to form deposits and/or sludge in various engine components for example in pistons. Therefore it would be advantageous to employ a viscosity modifier that reduces/prevents deposits and/or sludge in an internal combustion engine. In one embodiment the present invention provides a viscosity modifier that capable of at least one of improved fuel economy, reduced/prevented deposit, soot or sludge formation, and low temperature performance in an internal combustion engine.

SUMMARY OF THE INVENTION

In one embodiment the invention provides a lubricating composition comprising:

(a) 0.001 wt % to 15 wt % of a polymer with radial or star architecture;

(b) an overbased detergent;

(c) a dispersant; and (d) an oil of lubricating viscosity.

In one embodiment the invention provides a lubricating composition comprising:

(a) 0.001 wt % to 15 wt % of a polymer with radial or star architecture;

(b) an overbased detergent;

(c) a dispersant;

(d) an antiwear agent, such as a metal dialkyldithiophosphate; and (e) an oil of lubricating viscosity.

In one embodiment the invention provides a lubricating composition comprising:

(a) 0.001 wt % to 15 wt % of a polymer with radial or star architecture;

(b) 0.1 wt % to 15 wt % of an overbased detergent;

(c) 0.1 wt % to 25 wt % of a dispersant; and (d) 45 wt % to 99.7 wt % of an oil of lubricating viscosity.

In one embodiment the invention provides a method for lubricating a mechanical device comprising a supplying to the mechanical device a lubricating composition, wherein the mechanical device comprises at least one of an internal combustion engine, a hydraulic system, a turbine system, a circulating oil system, or an industrial oil system a gear, a gearbox or a transmission, and wherein the lubricating composition comprises:

(a) 0.001 wt % to 15 wt % of a polymer with radial or star architecture;

(b) an overbased detergent;

(c) a dispersant; and (d) an oil of lubricating viscosity.

In one embodiment the invention provides a method for lubricating an internal combustion engine comprising a supplying to the internal combustion engine a lubricating composition, wherein the lubricating composition comprises:

(a) 0.001 wt % to 15 wt % of a polymer with radial or star architecture;

(b) an overbased detergent;

(c) a dispersant; and (d) an oil of lubricating viscosity.

DETAILED DESCRIPTION OF THE INVENTION

The present invention provides a lubricating composition and a method for lubricating a mechanical device as disclosed above.

Overbased Detergent

The lubricating composition comprises an overbased detergent, or mixtures thereof. The overbased detergent includes phenates (including alkyl phenates and sulphur containing phenates), sulphonates, salixarates, carboxylates (such as salicylates), overbased phosphorus acids; alkyl phenols, overbased sulphur coupled alkyl phenol compounds, or saligenin detergents. In one embodiment the overbased detergent comprises one or more of salixarates, phenates, sulphonates, or salicylates. In one embodiment the overbased detergent is a salicylate. In one embodiment the overbased detergent is a sulphonate. In one embodiment the overbased detergent is a phenate. In one embodiment the overbased detergent is a salixarate.

Acidic Overbasing Agent

The acidic overbasing agent used to prepare the overbased detergent may be a liquid, such as formic acid, acetic acid or nitric acid. Suitable inorganic acidic agents include $SO_2$, carbon dioxide, or mixtures thereof. In different embodiments the acidic overbasing agent is carbon dioxide or acetic acid. In one embodiment the acidic overbasing agent is a mixture of carbon dioxide and acetic acid.

Various overbased detergents and their methods of preparation are described in greater detail in numerous patent publications, including WO2004/096957 and references cited therein. Typically the overbased detergents may be prepared from the reaction of a metal base, an acidic agent and an organic substrate (e.g., an alkyl phenol, salicylic acid or alkyl-substituted benzene sulphonic acid). The metal base typically includes calcium hydroxide, calcium oxide, calcium carbonate, magnesium oxide, magnesium hydroxide or magnesium carbonate.

When the overbased detergent comprises at least one of a phenate, salixarate or salicylate detergent, the TBN may be 105 to 450, or from 110 to 400, or from 120 to 350.

When the overbased detergent comprises an overbased sulphonate, the TBN may be 200 or more to 500, or 350 to 450.

The overbased detergent is typically salted with an alkali or alkaline earth metal. The alkali metal includes lithium, potassium or sodium; and the alkaline earth metal includes calcium or magnesium. In one embodiment the alkali metal is sodium. In one embodiment the alkaline earth metal is calcium. In one embodiment the alkaline earth metal is magnesium.

In one embodiment the overbased detergent comprises a salixarate. The salixarate typically has an organic substrate of a salixarene. The salixarene may be represented by a substantially linear compound comprising at least one unit of the formulae (I) or (II):

(I)

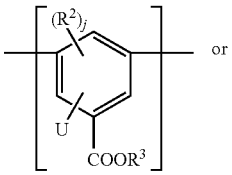

or (II)

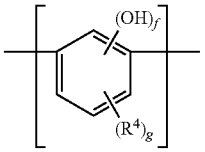

each end of the compound having a terminal group of formulae (III) or (IV):

(III)

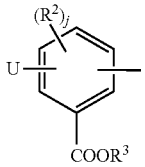

(IV)

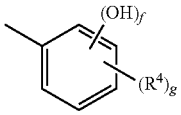

such groups being linked by divalent bridging groups, which may be the same or different for each linkage; wherein f is 1, 2 or 3, in one aspect 1 or 2; $R^1$ is a hydrocarbyl group containing 1 to 5 carbon atoms; $R^2$ is hydroxyl or a hydrocarbyl group; j is 0, 1, or 2; $R^3$ is hydrogen or a hydrocarbyl group; $R^4$ is a hydrocarbyl group or a substituted hydrocarbyl group; g is 1, 2 or 3, provided at least one $R^4$ group contains 8 or more carbon atoms; and wherein the compound on average contains at least one of unit (I) or (III) and at least one of unit (II) or (IV) and the ratio of the total number of units (I) and (III) to the total number of units of (II) and (IV) in the composition is about 0.1:1 to about 2:1.

The U group in formulae (I) and (III) may be located in one or more positions ortho, meta, or para to the —$COOR^3$ group. The U group may be located ortho to the —$COOR^3$ group. The U group may comprise an —OH group, in which case formulae (I) and (III) are derived from 2-hydroxybenzoic acid (often called salicylic acid), 3-hydroxybenzoic acid, 4-hydroxybenzoic acid or mixtures thereof. The U group may comprise an —$NH_2$ group, in which case formulae (I) and (III) are derived from 2-aminobenzoic acid (often called anthranilic acid), 3-aminobenzoic acid, 4-aminobenzoic acid or mixtures thereof.

The divalent bridging group, which may be the same or different in each occurrence, includes a methylene bridge such as —$CH_2$— or —CH(R)— and an ether bridge such as —$CH_2OCH_2$— or —CH(R)OCH(R)— where R is an alkyl group having 1 to 5 carbon atoms and where the methylene and ether bridges are derived from formaldehyde or an aldehyde having 2 to 6 carbon atoms.

Often the terminal group of formulae (III) or (IV) contains 1 or 2 hydroxymethyl groups ortho to a hydroxy group. In one embodiment of the invention hydroxymethyl groups are present. In one embodiment of the invention hydroxymethyl groups are not present. A more detailed description of salixarene and salixarate chemistry is disclosed in EP 1 419 226 B1, including methods of preparation as defined in Examples 1 to 23 (page 11, line 42 to page 13, line 47).

In one embodiment the overbased detergent comprises an overbased sulphonate. The overbased sulphonate typically includes a hydrocarbyl substituted arene sulphonic acid of an alkali metal, alkaline earth metal or mixtures thereof. The hydrocarbyl substituted arene sulphonic acid may be synthetic or natural. The arene group of the aryl sulphonic acid may be benzene, toluene or naphthylene. In one embodiment the hydrocarbyl substituted arene sulphonic acid comprises alkyl substituted benzene sulphonic acid. In different embodiments the overbased sulphonate may be a sodium salt of the hydrocarbyl substituted arene sulphonic acid, a calcium salt of the hydrocarbyl substituted arene sulphonic acid, or a magnesium salt of the hydrocarbyl substituted arene sulphonic acid.

The hydrocarbyl group (typically an alkyl group) may contain 8 to 40 or 10 to 36 carbon atoms. In different embodiments the overbased detergent may be a polypropene benzenesulphonic acid, or $C_{16}$-$C_{36}$ alkyl benzenesulphonic acid, or $C_{16}$-$C_{26}$ alkyl benzenesulphonic acid, or $C_{10}$-$C_{15}$ alkyl benzenesulphonic acid.

In one embodiment the overbased detergent comprises mixtures of at least two substrates. When two or more detergent substrates are used, the overbased detergent formed may be described as a complex/hybrid. Typically the complex/hybrid may be prepared by reacting in the presence of the suspension and acidifying overbasing agent, alkyl aromatic sulphonic acid at least one alkyl phenol (such as, alkyl phenol, aldehyde-coupled alkyl phenol, sulphurised alkyl phenol) and optionally alkyl salicylic acid. A more detailed description of hybrid detergents is disclosed in WO97046643.

The detergent may be present at 0.1 wt % to 10 wt %, or 0.1 wt % to 8 wt %, or 1 wt % to 4 wt %, or greater than 4 to 8 wt %.

Polymer

As used herein terms such as "the polymer has (or contains) monomers or composed of" means the polymer comprises units derived from the particular monomer referred to.

In different embodiments the polymer may contain about 20 wt % or more, or greater than 50 wt %, or about 55 wt % or more, or about 70 wt % or more, or about 90 wt % or more, or about 95 wt % or more, or about 100 wt % of a non-diene monomer (that is to say, non-diene monomer units or units derived from polymerisation of one of more non-diene monomers). Examples of diene monomers include 1,3-butadiene or isoprene. Examples of a non-diene or mono-vinyl monomer include styrene, methacrylates, or acrylates.

In one embodiment the polymer may be derived from 20 wt % or more of a mono-vinyl monomer, wherein the polymer has a weight average molecular weight of 100,000 to 1,000,000, or 200,000 to 1,000,000, or 300,000 to 1,000,000, or 350,000 to 1,000,000, or 400,000 to 800,000.

In one embodiment the polymer may have a shear stability as measured by ASTM D6278 at 100° C. (or CEC-L-14A-93, except shear measurements are determined after 30 cycles at 100° C.). In different embodiments the shear stability is such that the final lubricating composition (after testing) has a viscosity decrease of less than 30%, or 20% or less, or 15% or less, or 10% or less.

Typically the amount of mono-vinyl monomer as described above refers only to the composition of the polymeric arms of the polymer with radial or star architecture, i.e., the wt % values as given are exclusive of any di-functional (or higher) monomer found in a polymer core.

As described hereinafter the molecular weight of the viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312. As used herein the weight average and number average molecular weights of the polymers of the invention are obtained by integrating the area under the peak corresponding to the polymer of the invention, which is normally the major high molecular weight peak, excluding peaks associated with diluents, impurities, uncoupled polymer chains and other additives. Typically, the polymer of the invention has radial or star architecture.

The polymer may be a homopolymer or a copolymer. In one embodiment the polymer is a copolymer. The polymer may be a polymer having a random, tapered, di-block, tri-block or multi-block architecture. Typically the polymer has random or tapered architecture.

The polymer with radial or star architecture typically has polymeric arms. For such materials, the polymeric arms may have block architecture, or hetero architecture, or tapered architecture. Tapered-arm architecture has a variable composition across the length of a polymer arm. For example, the tapered arm may be composed of, at one end, a relatively pure first monomer and, at the other end, a relatively pure second monomer. The middle of the arm is more of a gradient composition of the two monomers.

The polymer derived from a block-arm typically contains one or more polymer arms derived from two or more monomers in block structure within the same arm. A more detailed description of the block-arm is given in Chapter 13 (pp. 333-368) of "Anionic Polymerization, Principles and Practical Applications" by Henry Hsieh and Roderic Quirk (Marcel Dekker, Inc, New York, 1996) (hereinafter referred to as Hsieh et al.).

The hetero-arm, or "mikto-arm," polymeric arm architecture typically contains arms which may vary from one another either in molecular weight, composition, or both, as defined in Hsieh et al., cited above. For example, a portion of the arms of a given polymer may be of one polymeric type and a portion of a second polymeric type. More complex hetero-arm polymers may be formed by combining portions of three or more polymeric arms with a coupling agent.

The polymer with radial or star architecture typically contains polymeric arms that may be chemically bonded to a core portion. The core portion may be a polyvalent(meth)acrylic monomer, oligomer, polymer, or copolymer thereof, or a polyvalent divinyl non-acrylic monomer, oligomer polymer, or copolymer thereof. In one embodiment the polyvalent divinyl non-acrylic monomer is divinyl benzene. In one embodiment the polyvalent(meth)acrylic monomer is an acrylate or methacrylate ester of a polyol or a methacrylamide of a polyamine, such as an amide of a polyamine, for instance a methacrylamide or an acrylamide. In different embodiments the polyvalent(meth)acrylic monomer is (i) a condensation reaction product of an acrylic or methacrylic acid with a polyol or (ii) a condensation reaction product of an acrylic or methacrylic acid with a polyamine.

The polyol which may be condensed with the acrylic or methacrylic acid in different embodiments may contain 2 to 20, or 3 to 15, or 4 to 12 carbon atoms; and the number of hydroxyl groups present may be 2 to 10, or 2 to 4, or 2. Examples of polyols include ethylene glycol, poly(ethylene glycols), alkane diols such as 1,6-hexanene diol or triols such as trimethylolpropane, oligomerised trimethylolpropanes such as Boltorn® materials sold by Perstorp Polyols. Examples of polyamines include polyalkylenepolyamines such as ethylenediamine, diethylenetriamine, triethylenetetramine, tetraethylene pentamine, pentaethylenehexamine and mixtures thereof.

Examples of the polyvalent unsaturated(meth)acrylic monomer include ethylene glycol diacrylate, ethylene glycol dimethacrylate, diethylene glycol diacrylate, diethylene glycol dimethacrylate, glycerol diacrylate, glycerol triacrylate, mannitol hexaacrylate, 4-cyclohexanediol diacrylate, 1,4-benzenediol dimethacrylate, pentaerythritol tetraacrylate, 1,3-propanediol diacrylate, 1,5-pentanediol dimethacrylate, bis-acrylates and methacrylates of polyethylene glycols of molecular weight 200 to 4000, polycaprolactonediol diacrylate, pentaerythritol triacrylate, 1,1,1-trimethylolpropane triacrylate, pentaerythritol diacrylate, pentaerythritol triacrylate, pentaerythritol tetraacrylate, triethylene glycol diacrylate, triethylene glycol dimethacrylate, 1,1,1-trimethylolpropane trimethacrylate, hexamethylenediol diacrylate or hexamethylenediol dimethacrylate or an alkylene bis-(meth) acrylamide.

The amount of polyvalent coupling agent may be an amount suitable to provide coupling of polymer previously prepared as arms onto a core comprising the coupling agent in monomeric, oligomeric, or polymeric form, to provide a star polymer. As described above, suitable amounts may be determined readily by the person skilled in the art with minimal experimentation, even though several variables may be involved. For example, if an excessive amount of coupling agent is employed, or if excessive unreacted monomer from the formation of the polymeric arms remains in the system, crosslinking rather than star formation may occur. Typically the mole ratio of polymer arms to coupling agent may be 50:1 to 1.5:1 (or 1:1), or 30:1 to 2:1, or 10:1 to 3:1, or 7:1 to 4:1, or 4:1 to 1:1. In other embodiments the mole ratio of polymer arms to coupling agent may be 50:1 to 0.5:1, or 30:1 to 1:1, or 7:1 to 2:1. The desired ratio may also be adjusted to take into account the length of the arms, longer arms sometimes tolerating or requiring more coupling agent than shorter arms. Typically the material prepared is soluble in an oil of lubricating viscosity.

In one embodiment the polymeric arms of the polymer have a polydispersity of 2 or less, or 1.7 or less, or 1.5 or less, for instance, 1 to 1.4 as measured before radial or star polymer formation or on uncoupled units. In one embodiment the overall polymer composition, which includes the polymer with radial or star architecture, has polydispersity with a bimodal or higher modal distribution. The bimodal or higher distribution in the overall composition is believed to be partially due to the presence of varying amounts of uncoupled polymer chains and/or uncoupled radial or star-polymers or star-to-star coupling formed as the polymer is prepared.

The overall composition containing polymers with the radial or star architecture may thus also have uncoupled polymeric arms present (also referred to as a polymer chain or linear polymer). The percentage conversion of a polymer chain to radial or star polymer may be at least 10%, or at least 20%, or at least 40%, or at least 55%, for instance at least 70%, at least 75% or at least 80%. In one embodiment the conversion of polymer chain to radial or star polymer may be 90%, 95% or 100%. In one embodiment a portion of the polymer chains does not form a star polymer and remains as a linear polymer. In one embodiment the polymer is a mixture of (i) a polymer with radial or star architecture, and (ii) linear polymer chains (also referred to as uncoupled polymeric arms). In different embodiments the amount of radial or star architecture within the polymer composition may be 10 wt % to 85 wt %, or 25 wt % to 70 wt % of the amount of polymer. In different embodiments the linear polymer chains may be present at 15 wt % to 90 wt %, or 30 wt % to 75 wt % of the amount of polymer.

The polymer with branched, comb-like, radial or star architecture may have 2 or more arms, or 5 or more arms, or 7 or more arms, or 10 or more arms, for instance 12 to 100, or 14 to 50, or 16 to 40 arms. The polymer with branched, comb-like, radial or star architecture may have 120 arms or less, or 80 arms or less, or 60 arms or less.

The polymer may be obtained/obtainable from a controlled radical polymerisation technique. Examples of a controlled radical polymerisation technique include RAFT, ATRP or nitroxide mediated processes. The polymer may also be obtained/obtainable from anionic polymerisation processes. In one embodiment the polymer may be obtained/obtainable from RAFT, ATRP or anionic polymerisation processes. In one embodiment the polymer may be obtained/obtainable from RAFT or ATRP polymerisation processes. In one embodiment the polymer may be obtained/obtainable from a RAFT polymerisation process.

Methods of preparing polymers using ATRP, RAFT or nitroxide-mediated techniques are disclosed in the example section of US Patent Application US05/038146, examples 1 to 47.

More detailed descriptions of polymerisation mechanisms and related chemistry is discussed for nitroxide-mediated polymerisation (Chapter 10, pages 463 to 522), ATRP (Chapter 11, pages 523 to 628) and RAFT (Chapter 12, pages 629 to 690) in the *Handbook of Radical Polymerization*, edited by Krzysztof Matyjaszewski and Thomas P. Davis, 2002, published by John Wiley and Sons Inc (hereinafter referred to as "Matyjaszewski et al.").

The discussion of the polymer mechanism of ATRP polymerisation is shown on page 524 in reaction scheme 11.1, page 566 reaction scheme 11.4, reaction scheme 11.7 on page 571, reaction scheme 11.8 on page 572 and reaction scheme 11.9 on page 575 of Matyjaszewski et al.

In ATRP polymerisation, groups that may be transferred by a radical mechanism include halogens (from a halogen-containing compound) or various ligands. A more detailed review of groups that may be transferred is described in U.S. Pat. No. 6,391,996, or paragraphs 61 to 65 of US Patent Application US05/038146.

Examples of a halogen-containing compound that may be used in ATRP polymerisation include benzyl halides such as p-chloromethylstyrene, α-dichloroxylene, α,α-dichloroxylene, α,α-dibromoxylene, hexakis(α-bromomethyl)benzene, benzyl chloride, benzyl bromide, 1-bromo-1-phenylethane and 1-chloro-1-phenylethane; carboxylic acid derivatives which are halogenated at the α-position, such as propyl 2-bromopropionate, methyl 2-chloropropionate, ethyl 2-chloropropionate, methyl 2-bromopropionate, and ethyl 2-bromoisobutyrate; tosyl halides such as p-toluenesulfonyl chloride; alkyl halides such as tetrachloromethane, tribromomethane, 1-vinylethyl chloride, and 1-vinylethyl bromide; and halogen derivatives of phosphoric acid esters, such as dimethylphosphoric acid.

In one embodiment when the halogen compound is employed, a transition metal such as copper is also present. The transition metal may be in the form of a salt. The transition metal is capable of forming a metal-to-ligand bond and the ratio of ligand to metal depends on the dentate number of the ligand and the co-ordination number of the metal. The ligand may be a nitrogen or phosphorus-containing ligand.

Examples of a suitable ligand include triphenylphosphine, 2,2-bipyridine, alkyl-2,2-bipyridine, such as 4,4-di-(5-heptyl)-2,2-bipyridine, tris(2-aminoethyl)amine (TREN), N,N,N',N',N"-pentamethyldiethylenetriamine, 4,4-di-(5-nonyl)-2,2-bipyridine, 1,1,4,7,10,10-hexamethyltriethylenetetramine and/or tetramethylethylenediamine. Further suitable ligands are described in, for example, International Patent application WO 97/47661. The ligands may be used individually or as a mixture. In one embodiment the nitrogen containing ligand is employed in the presence of copper. In one embodiment the ligand is phosphorus-containing with triphenyl phosphine ($PPh_3$) a common ligand. A suitable transition metal for a triphenyl phosphine ligand includes Rh, Ru, Fe, Re, Ni or Pd.

In RAFT polymerisation, chain transfer agents are important. A more detailed review of suitable chain transfer agents is found in paragraphs 66 to 71 of US Patent Application US05/038146. Examples of a suitable RAFT chain transfer agent include benzyl 1-(2-pyrrolidinone)carbodithioate, benzyl(1,2-benzenedicarboximido) carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-S-benzyl dithiocarbamate, cyanomethyl 1-(2-pyrrolidone) carbodithioate, cumyl dithiobenzoate, 2-dodecylsulphanylthiocarbonylsulphanyl-2-methyl-propionic acid butyl ester, O-phenyl-5-benzyl xanthate, N,N-diethyl S-(2-ethoxy-carbonylprop-2-yl)dithiocarbamate, dithiobenzoic acid, 4-chlorodithiobenzoic acid, O-ethyl-S-(1-phenylethyl)xanthate, O-ethyl-S-(2-(ethoxycarbonyl) prop-2-yl)xanthate, O-ethyl-S-(2-cyanoprop-2-yl)xanthate, O-ethyl-S-(2-cyanoprop-2-yl)xanthate, O-ethyl-S-cyanomethyl xanthate, O-pentafluorophenyl-S-benzyl xanthate, 3-benzylthio-5,5-dimethylcyclohex-2-ene-1-thione or benzyl 3,3-di(benzylthio)prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-(α,α'-disubstituted-α"-acetic acid)-trithiocarbonates, benzyl dithiobenzoate, 1-phenylethyl dithiobenzoate, 2-phenylprop-2-yl dithiobenzoate, 1-acetoxyethyl dithiobenzoate, hexakis(thiobenzoylthiomethyl)benzene, 1,4-bis(thiobenzoylthiomethyl)benzene, 1,2,4,5-tetrakis(thiobenzoylthiomethyl)benzene, 1,4-bis-(2-(thiobenzoylthio)-prop-2-yl)benzene, 1-(4-methoxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithiobenzoate, 2-(4-chlorophenyl)prop-2-yl dithiobenzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithiobenzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof.

In one embodiment a suitable RAFT chain transfer agent includes 2-dodecylsulfanylthiocarbonylsulfanyl-2-methyl-propionic acid butyl ester, cumyl dithiobenzoate or mixtures thereof.

A discussion of the polymer mechanism of RAFT polymerisation is shown on page 664 to 665 in section 12.4.4 of Matyjaszewski et al.

When the polymer is prepared from anionic polymerisation techniques, initiators include, for example, hydrocarbyllithium initiators such as alkyllithium compounds (e.g., methyl lithium, n-butyl lithium, sec-butyl lithium), cycloalkyllithium compounds (e.g., cyclohexyl lithium and aryl lithium compounds (e.g., phenyl lithium, 1-methylstyryl lithium, p-tolyl lithium, naphyl lithium and 1,1-diphenyl-3-methylpentyl lithium. Also, useful initiators include naphthalene sodium, 1,4-disodio-1,1,4,4-tetraphenylbutane, diphenylmethyl potassium or diphenylmethyl sodium.

The polymerisation process may also be carried out in the absence of moisture and oxygen and in the presence of at least one inert solvent. In one embodiment anionic polymerisation is conducted in the absence of any impurity which is detrimental to an anionic catalyst system. The inert solvent includes a hydrocarbon, an aromatic solvent or ether. Suitable solvents include isobutane, pentane, cyclohexane, benzene, toluene, xylene, tetrahydrofuran, diglyme, tetraglyme, ortho-terphenyl, biphenyl, decalin or tetralin.

The anionic polymerisation process may be carried out at a temperature of 0° C. to −78° C.

A more detailed description of process to prepare the polymer derived from anionic processes is discussed in International Patent Application WO 96/23012, page 3, line 11 to page 5, line 8. Page 7, line 25 to page 10, line 15 of WO 96/23012 further describes methods of preparing polymers by anionic polymerisation techniques. A detailed description of anionic polymerisation process is given in *Textbook of Polymer Science*, edited by Fred W. Billmeyer Jr., Third Edition, 1984, Chapter 4, pages 88-90.

The polymer may comprise at least one of (a) a polymer derived from monomers comprising: (i) a vinyl aromatic monomer; and (ii) a carboxylic monomer (typically maleic anhydride, maleic acid, (meth)acrylic acid, itaconic anhydride or itaconic acid) or derivatives thereof; (b) a poly(meth) acrylate; (c) a functionalised polyolefin; (d) an ethylene vinyl acetate copolymer; (e) a fumarate copolymer; (f) a copolymer derived from (i) an α-olefin and (ii) a carboxylic monomer (typically maleic anhydride, maleic acid, (meth)acrylic acid, itaconic anhydride or itaconic acid) or derivatives thereof; or (g) mixtures thereof. In one embodiment the polymer with pendant groups comprises a polymethacrylate or mixtures thereof.

When the polymer is a polymethacrylate, the polymer may be derived from a monomer composition comprising:

(a) 50 wt % to 100 wt % (or 65 wt % to 95 wt %) of an alkyl methacrylate, wherein the alkyl group of the methacrylate has 10 to 30, or 10 to 20, or 12 to 18, or 12 to 15 carbon atoms;

(b) 0 wt % to 40 wt % (or 5 wt % to 30 wt %) of an alkyl methacrylate, wherein the alkyl group of the methacrylate has 1 to 9, or 1 to 4 carbon atoms (for example methyl, butyl, or 2-ethylhexyl); and (c) 0 wt % to 10 wt % (or 0 wt % to 5 wt %) of a nitrogen-containing monomer.

As used herein the term (meth)acrylate means acrylate or methacrylate units. The alkyl(meth)acrylate includes for example compounds derived from saturated alcohols, such as methyl methacrylate, butyl methacrylate, 2-methylpentyl, 2-propylheptyl, 2-butyloctyl, 2-ethylhexyl(meth)acrylate, octyl(meth)acrylate, nonyl(meth)acrylate, isooctyl(meth)

acrylate, isononyl(meth)acrylate, 2-tert-butylheptyl(meth) acrylate, 3-isopropylheptyl(meth)-acrylate, decyl(meth) acrylate, undecyl(meth)acrylate, 5-methylundecyl(meth)-acrylate, do decyl(meth)acrylate, 2-methyldodecyl(meth) acrylate, tridecyl(meth)acrylate, 5-methyltridecyl(meth) acrylate, tetradecyl(meth)acrylate, pentadecyl(meth) acrylate, hexadecyl(meth)acrylate, 2-methylhexadecyl (meth)acrylate, heptadecyl(meth)acrylate, 5-isopropylheptadecyl(meth)acrylate, 4-tert-butyloctadecyl (meth)acrylate, 5-ethyloctadecyl(meth)acrylate, 3-isopropyloctadecyl-(meth)acrylate, octadecyl(meth)acrylate, nonadecyl(meth)acrylate, eicosyl(meth)acrylate, cetyleicosyl(meth) acrylate, stearyleicosyl(meth)acrylate, docosyl(meth) acrylate and/or eicosyltetratriacontyl(meth)acrylate; (meth) acrylates derived from unsaturated alcohols, such as oleyl (meth)acrylate; and cycloalkyl(meth)acrylates, such as 3-vinyl-2-butylcyclohexyl(meth)acrylate or bornyl(meth) acrylate.

The alkyl(meth)acrylates with long-chain alcohol-derived groups may be obtained, for example, by reaction of a (meth) acrylic acid (by direct esterification) or methyl methacrylate (by transesterification) with long-chain fatty alcohols, in which reaction a mixture of esters such as (meth)acrylate with alcohol groups of various chain lengths is generally obtained. These fatty alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

In one embodiment the star polymer is further functionalised in the core or the polymeric arms with a nitrogen-containing monomer. The nitrogen-containing monomer may include a vinyl-substituted nitrogen heterocyclic monomer, a dialkylaminoalkyl(meth)acrylate monomer, a dialkylaminoalkyl methacrylamide monomer, a tertiary-methacrylamide, a dialkylaminoalkyl acrylamide monomer, a tertiary-acrylamide monomer or mixtures thereof.

In one embodiment the core or polymeric arms further comprise a (meth)acrylamide or a nitrogen containing (meth) acrylate monomer that may be represented by the formula:

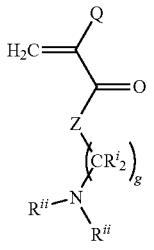

wherein

Q is hydrogen or methyl and, in one embodiment, Q is methyl;

Z is an N—H group or O (oxygen);

each $R^{ii}$ is independently hydrogen or a hydrocarbyl group containing 1 to 8, or 1 to 4 carbon atoms;

each $R^{i}$ is independently hydrogen or a hydrocarbyl group containing 1 to 2 carbon atoms and, in one embodiment, each R' is hydrogen; and g is an integer from 1 to 6 and, in one embodiment, g is 1 to 3.

Examples of a suitable nitrogen-containing monomer include N,N-dimethylacrylamide, N-vinyl carbonamides such as N-vinyl-formamide, vinyl pyridine, N-vinylacetamide, N-vinyl-n-propionamides, N-vinyl hydroxyacetamide, N-vinyl imidazole, N-vinyl pyrrolidinone, N-vinyl caprolactam, dimethylaminoethyl acrylate (DMAEA), dimethylaminoethylmethacrylate (DMAEMA), dimethylaminobutylacrylamide, dimethylamine-propylmethacrylate (DMAPMA), dimethylamine-propyl-acrylamide, dimethylaminopropylmethacrylamide, dimethylaminoethyl-acrylamide or mixtures thereof.

The polymer may be present at 0.01 to 12 wt %, or 0.05 wt % to 10 wt %, or 0.075 to 8 wt % of the lubricating composition.

Dispersant

The lubricating composition comprises a dispersant. The dispersant may be a succinimide dispersant (for example N-substituted long chain alkenyl succinimides), a Mannich dispersant, an ester-containing dispersant, a condensation product of a long chain hydrocarbyl (such as a fatty hydrocarbyl or polyisobutylene)monocarboxylic acylating agent with an amine or ammonia, an alkyl amino phenol dispersant, a hydrocarbyl-amine dispersant, a polyether dispersant, or a polyetheramine dispersant.

In different embodiments the dispersant may be a succinimide, succinic acid ester, or Mannich dispersant.

In several embodiments the N-substituted long chain alkenyl succinimides contain an average of at least 8, or 30, or 35 up to 350, or to 200, or to 100 carbon atoms. In one embodiment, the long chain alkenyl group is derived from a polyalkene characterised by an $\overline{M}_n$ (number average molecular weight) of at least 500. Generally, the polyalkene is characterised by an $\overline{M}_n$ of 500, or 700, or 800, or even 900 up to 5000, or to 2500, or to 2000, or even to 1500 or 1200. In one embodiment the long chain alkenyl group is derived form polyolefins. The polyolefins may be derived from monomers including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful polyolefins include polyisobutylenes having a number average molecular weight of 140 to 5000, in another instance of 400 to 2500, and in a further instance of 140 or 500 to 1500. The polyisobutylene may have a vinylidene double bond content of 5 to 69%, in a second instance of 50 to 69%, and in a third instance of 50 to 95%.

In one embodiment the succinimide dispersant comprises a polyisobutylene succinimide, wherein the polyisobutylene has a number average molecular weight of 140 to 5000, or 300 to 5000, or 500 to 3000.

Succinimide dispersants and their methods of preparation are more fully described in U.S. Pat. Nos. 4,234,435 and 3,172,892.

Suitable ester-containing dispersants are typically high molecular weight esters. These materials are described in more detail in U.S. Pat. No. 3,381,022.

Mannich dispersants are the reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, which are commercially available.

Hydrocarbyl-amine dispersants are hydrocarbyl-substituted amines. The hydrocarbyl-substituted amine may be formed by heating a mixture of a chlorinated olefin or polyolefin such as a chlorinated polyisobutylene with an amine such as ethylenediamine in the presence of a base such as sodium carbonate as described in U.S. Pat. No. 5,407,453.

Polyether dispersants include polyetheramines, polyether amides, polyether carbamates, and polyether alcohols. Polyetheramines and their methods of preparation are described in greater detail in U.S. Pat. No. 6,458,172, columns 4 and 5.

In one embodiment the invention further comprises at least one dispersant derived from polyisobutylene succinic anhydride, an amine and zinc oxide to form a polyisobutylene succinimide complex with zinc. The polyisobutylene succinimide complex with zinc may be used alone or in combination.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, phosphorus compounds and/or metal compounds. In one embodiment the dispersant is a borated dispersant. Typically the borated dispersant comprises the succinimide dispersant comprises a polyisobutylene succinimide, wherein the polyisobutylene has a number average molecular weight of 140 to 5000, or 300 to 5000, or 500 to 3000.

In one embodiment the dispersant may be prepared by heating (i) a dispersant material described above (for example N-substituted long chain alkenyl succinimides), (ii) 2,5-dimercapto-1,3,4-thiadiazole or a hydrocarbyl-substituted 2,5-dimercapto-1,3,4-thiadiazole, or oligomers thereof, (iii) a borating agent, and (iv) optionally a dicarboxylic acid of an aromatic compound selected from the group consisting of 1,3 diacids and 1,4 diacids; or (v) optionally a phosphorus acid compound, said heating being sufficient to provide a product of (i), (ii), (iii) and optionally (iv) or (v), which is soluble in an oil of lubricating viscosity. The dispersant prepared by heating is described in more detail in US Patent Applications US04/027094 and 60/654,164.

The dispersant may be present at 0.1 wt % to 20 wt %, or 0.25 wt % to 15 wt %, or 0.5 wt % to 10 wt %, or 1 wt % to 6 wt %, or 7 wt % to 12 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof. In one embodiment the oil of lubricating viscosity is a API Group III oil.

The amount of the oil of lubricating viscosity present is typically the balance remaining after subtracting from 100 wt % the sum of the amount of the polymer, the overbased detergent, the dispersant and other performance additives.

The lubricating composition may be in the form of a concentrate and/or a fully formulated lubricant. If the polymer, the overbased detergent, the dispersant are in the form of a concentrate (which may be combined with additional oil to form, in whole or in part, a finished lubricant), the ratio of the of components (a), (b) and (c) (i.e. the polymer, the overbased detergent, the dispersant to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives comprise at least one of metal deactivators, viscosity modifiers, friction modifiers, antiwear agents, corrosion inhibitors, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

Antioxidants

Antioxidant compounds are known and include for example, sulphurised olefins, alkylated diphenylamines (typically di-nonyl diphenylamine, octyl diphenylamine, dioctyl diphenylamine), hindered phenols, molybdenum compounds (such as molybdenum dithiocarbamates), or mixtures thereof. Antioxidant compounds may be used alone or in combination. The antioxidant may be present in ranges 0 wt % to 20 wt %, or 0.1 wt % to 10 wt %, or 1 wt % to 5 wt %, of the lubricating composition.

In one embodiment the antioxidant is a molybdenum compound. Typically the molybdenum compound provides 10 to 2000, or 20 to 1000, or 50 to 500 parts per million by weight molybdenum to the lubricating composition.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba, or a condensation product derived from 2,6-di-tert-butylphenol and an alkyl acrylate, wherein the alkyl group may contain 1 to 18, or 2 to 12, or 2 to 8, or 2 to 6, or 4 carbon atoms. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 and S-600 from Asahi Denka Kogyo K. K and mixtures thereof.

Antiwear Agents

The lubricant composition optionally further comprises at least one other antiwear agent. The antiwear agent may be present in ranges including 0 wt % to 15 wt %, or 0.1 wt % to 10 wt % or 1 wt % to 8 wt % of the lubricating composition. Examples of suitable antiwear agents include phosphate esters, sulphurised olefins, sulphur-containing ashless antiwear additives are metal dihydrocarbyldithiophosphates (such as zinc dialkyldithiophosphates or molybdenum dialkyldithiophosphates), thiocarbamate-containing compounds, such as thiocarbamate esters, thiocarbamate amides, thiocarbamic ethers, alkylene-coupled thiocarbamates, and bis(S-alkyldithiocarbamyl)disulphides.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins such as alpha-olefins e.g., 1-hexadecene.

In an alternative embodiment, the ashless antiwear agent (which may also be described as a friction modifier) may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the ashless antiwear agent mixture include 5 to 95, or in other embodiments 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

Viscosity Modifiers

Viscosity modifiers other than the polymer (a) of the invention, including hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, alkenyl aryl conjugated diene copolymers, polyolefins, esters of maleic anhydride-styrene copolymers. Conventional poly(meth)acrylate polymers may be derived from monomers substantially the same as those defined for the polymeric arms. However, the conventional poly(meth)acrylate is generally free of a functional group selected from a halogen, an —O—N═ group and an —S—C(═S)— group. In one embodiment the polymer of the invention is mixed with a conventional viscosity modifier.

The viscosity modifier other than polymer (a) of the invention may be present at 0 wt % to 15 wt %, or 0.01 to 12 wt %, or 0.05 to 10 wt %, or 0.075 to 8 wt % of the lubricating composition.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Other Additives

Other performance additives such as corrosion inhibitors include those described in paragraphs 5 to 8 of US Application US05/038319 (filed on Oct. 25, 2004 McAtee and Boyer as named inventors), octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Friction modifiers including fatty acid derivatives such as amines, esters, epoxides, fatty imidazolines, condensation products of carboxylic acids and polyalkylene-polyamines and amine salts of alkylphosphoric acids, fatty alkyl tartrates (typically fatty dialkyl tartrates), fatty alkyl tartrimides, fatty alkyl tartramides (typically fatty dialkyl tartramides) may also be used in the lubricant composition. Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid (several of these friction modifiers have been described above as antioxidants or as antiwear agents). Friction modifiers may be present in ranges including 0 wt % to 10 wt % or 0.1 wt % to 8 wt % or 1 wt % to 5 wt % of the lubricating composition.

INDUSTRIAL APPLICATION

The method of the invention is useful for lubricating a variety of mechanical devices. The mechanical device comprises at least one of an internal combustion engine (for crankcase lubrication), a hydraulic system, a turbine system, a circulating oil system, an industrial oil system, a gear, a gearbox, an automatic transmission or a manual transmission.

In different embodiments the mechanical device comprises an internal combustion engine. The internal combustion engine may be a 2-stroke or a 4-stroke internal combustion engine and may or may not be sump-lubricated.

In one embodiment the internal combustion engine may be a diesel fuelled engine, a gasoline fuelled engine, a natural gas fuelled engine or a mixed gasoline/alcohol fuelled engine. In one embodiment the internal combustion engine is a diesel fuelled engine and in another embodiment a gasoline fuelled engine. Suitable internal combustion engines include marine diesel engines, aviation piston engines, low-load diesel engines, and automobile and truck engines.

In one embodiment the internal combustion engine comprises a crankcase, a gear and a wet-clutch. Optionally the internal combustion engine further comprises a manual or automatic transmission. In one embodiment the gear is from a gearbox.

As used herein the term "wet-clutch" is known to a person skilled in the art as meaning one that contains a clutch plate(s) that is bathed or sprayed by a lubricant, e.g., that of the transmission, and the lubricating oil gets between the plate(s).

In one embodiment the internal combustion engine has a common oil reservoir supplying the same lubricating composition to the crankcase and at least one of a gear and a wet-clutch. In certain embodiments the lubricating composition is supplied to the crankcase and to the gear (or multiplicity of gears), or to the crankcase and the wet clutch, or to the crankcase and both the gear (or gears) and the wet clutch.

In one embodiment the internal combustion engine is a 4-stroke engine. In one embodiment the internal combustion engine is also referred to generically as a small engine.

The small engine in one embodiment has a power output of 2.24 to 18.64 kW (3 to 25 horsepower (hp)), in another embodiment 2.98 to 4.53 kW (4 to 6 hp) and in another embodiment exhibits 100 or 200 $cm^3$ displacement. Examples of small engines include those in home/garden tools such as lawnmowers, hedge trimmers or chainsaws.

In one embodiment the internal combustion engine has a capacity of up to 3500 $cm^3$ displacement, in another embodiment up to 2500 $cm^3$ displacement and in another embodiment up to 2000 $cm^3$ displacement. Examples of suitable internal combustion engines with a capacity up to 2500 $cm^3$ displacement include motorcycles, snowmobiles, jet-skis, quad-bikes, or all-terrain vehicles. In one embodiment the internal combustion engine is a tractor or other agricultural vehicle such as a combined harvester.

In one embodiment the internal combustion engine is not a tractor or other agricultural vehicle. In another embodiment the internal combustion engine does not contain a dry-clutch i.e. a system that separates the engine from the transmission such as a transmission on an automotive vehicle. In another embodiment the internal combustion engine is not suitable for use with a diesel fuel.

In one embodiment the internal combustion engine is suitable for motorcycles for example motorcycles with a 4-stroke internal combustion engine.

In different embodiments the lubricating composition comprises a lubricant for an internal combustion engine with a SAE viscosity grade from XW-Y, wherein X is an integer from 0 to 20 and Y is an integer from 20 to 50.

In several embodiments X is an integer chosen from 0, 5, 10, 15 or 20; and Y is an integer chosen from 20, 25, 30, 35, 40, 45 or 50.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be 0.1 wt % to 0.5 wt %. The phosphorus content may be 0.2 wt % or less, or 0.1 wt % or less, or 0.085 wt % or less, or even 0.06 wt % or less, 0.055 wt % or less, or 0.05 wt % or less. In different embodiments the phosphorus content may be 0.01 wt % 0.075 wt %, or 0.01 wt % 0.06 wt %. The total sulphated ash content may be 2 wt % or less, or 1.5 wt % or less, or 1.1 wt % or less, or 1 wt % or less, or 0.8 wt % or less, or 0.5 wt % or less. In one embodiment the sulphated ash content may be 0.1 wt % to 0.5 wt %.

In one embodiment the lubricating composition comprises an engine oil, wherein the lubricating composition has a (i) a sulphur content of 0.5 wt % or less, (ii) a phosphorus content of 0.1 wt % or less, and (iii) a sulphated ash content of 1.5 wt % or less.

In one embodiment the lubricating composition is suitable for a 2-stroke or a 4-stroke marine diesel internal combustion engine. In one embodiment the marine diesel combustion engine is a 2-stroke engine. The polymer of the invention may be added to a marine diesel lubricating composition at 0.01 to 15 wt %, or 0.05 to 10 wt %, or 0.1 to 5 wt %.

The following examples provide illustrations of the invention. These examples are non exhaustive and are not intended to limit the scope of the invention.

EXAMPLES

For each chemical component used in the following examples, the amount presented exclusive of any solvent or diluent oil, which may be customarily present in the commercial material (i.e. each chemical component is presented on an actives basis).

Preparative Example 1

Prep 1

A vessel equipped with a nitrogen inlet flowing at 28.3 L/hr, medium speed mechanical stirrer, a thermocouple and a water-cooled condenser is charged with 80 g of $C_{12-15}$ alkyl methacrylate, 20 g of methyl methacrylate, 0.55 g of Trigonox™-21 (initiator), 4.07 g of 2-dodecylsulphanylthiocarbonylsulphanyl-2-methyl-propionic acid dodecyl ester (chain transfer agent) and 48.2 g of oil. The contents of the vessel are stirred under a nitrogen blanket for 20 minutes to ensure sufficient mixing. The nitrogen flow is reduced to 14.2 L/hr and the mixture is set to be heated to 90° C. for 3 hours. 6.05 g of ethylene glycol dimethacrylate is added to the vessel and the mixture is stirred at 90° C. for an additional 3 hours. The resultant product is a mixture of polymers and is then cooled to ambient temperature. The major product fraction is characterised as having a weight average molecular weight of 283,300 g/mol and having a number average molecular weight of 215,900 g/mol. The polymer is believed to have at least 9 polymeric arms (containing 80 wt % of $C_{12-15}$ alkylmethacrylate, 20 wt % of methyl methacrylate) and the conversion to a star polymer is 72%, with 28% uncoupled linear polymer chains.

Preparative Example 2

Prep 2

The process to prepare Prep 2 is similar to Prep 1 above, except the amounts of reactants are as follows: 0.63 g of chain transfer agent, 0.11 g of initiator, 68.8 g of C12-15 alkyl methacrylate, 11.2 g of methyl methacrylate, 1.58 g of ethylene glycol dimethacrylate. The resultant polymer has a weight average molecular weight of 407,600, and a number average molecular weight of 289,900. The star polymer is believed to have at least 5 arms, and the conversion to star polymer is 70%, with 30% uncoupled linear polymer chains.

Preparative Example 3

Prep 3

The process to prepare Prep 3 is similar to Prep 1 above, except the amounts of reactants are as follows: 0.71 g of chain transfer agent, 0.14 g of initiator, 80 g of C12-15 alkyl methacrylate, 20 g of methyl methacrylate, 1.59 g of ethylene glycol dimethacrylate. The resultant polymer has a weight average molecular weight of 696,100, and a number average molecular weight of 814,600. The star polymer is believed to have at least 6 arms, and the conversion to star polymer is 40%, with 60% uncoupled linear polymer chains.

Lubricating composition 1 (LC1) contains 6 wt % of the polymer from Prep 1, 1.4 wt % of dispersant, 0.6 wt % of 300 TBN sulphonate detergent, 1 wt % of 255 TBN phenate, 0.2 wt % of polyacrylate pour point depressant, 2 wt % of other additives (including antiwear agents and antifoam agents) and the balance to 100 wt % being base oil. LC1 has a viscosity grade of 10 W-40.

Comparative lubricating composition 1 (CLC1) is substantially the same as LC1, except the polymer from Prep 1 is replaced with 12 wt % of a commercially available linear polymethacrylate. The amount of base oil is modified accordingly in view of the increased amounts of polymer. CLC1 has a viscosity grade of 10 W-40.

The lubricating compositions LC1 and CLC1 are evaluated by determining the kinematic viscosity at 100° C. (using ASTM method D445) before and after subjecting the lubricating compositions to KRL tapered bearing shear test at 80° C. for 4 hours. The lubricating compositions are also evaluated for cold crank properties at −25° C. (using ASTM D5293) and high temperature high shear (HTHS) properties (using CEC-L-36-A-90). The results obtained as follows:

| Test | LC1 | CLC1 |
|---|---|---|
| Kinematic Viscosity at 100° C. (before shear test) | 12.17 | 12.44 |
| Kinematic Viscosity at 100° C. (after shear test) | 11.02 | 11.49 |
| Viscosity loss during test ($mm^2/s$) | 1.15 | 0.95 |
| Viscosity loss (%) | 9.45 | 7.64 |
| Cold crank properties at −25° C. | 6320 | 4410 |
| HTHS | 3.51 | 4.1 |

Lubricating composition 2 (LC2) contains 2.9 wt % of the polymer from Prep1, 0.9 wt % of 300 TBN overbased detergents, 3 wt % of succinimide dispersants, 0.2 wt % of a polyacrylate pour point depressant, and 1.8 wt % of other additives (including antiwear agents and antioxidants). LC2 has a viscosity grade of 0 W-20. LC2 has kinematic viscosity at 100° C. of 8.13 $mm^2/s$, cold crank properties at −35° C. (using ASTM D5293) of 6180, and high temperature high shear (HTHS) properties (using CEC-L-36-A-90) of 2.60.

Lubricating composition 3 (LC3) contains 2.9 wt % of the polymer from Prep2, 2.6 wt % dispersants, 0.9 wt % overbased detergents 0.3 wt % of polyacrylate pour point depressant, 2.5 wt % of other additives and balance is base oil. LC3 is then evaluated in a number of tests. The tests include high temperature high shear properties using ASTM method D4683 (result obtained: 3.19); and for cold crank properties using ASTM method D5293 at −30° C. (result obtained: 6059

$mm^2/s$). LC3 is also evaluated using Orbahn shear test (ASTM D6278). The results obtained include a final test viscosity is 10.09 $mm^2/s$, a viscosity loss (%) of 8.69, and a shear stability of 16.0.

Lubricating composition 4 (LC4) is substantially the same as LC3, except the polymer used is from Prep3 at 2.3 wt %, and the amount of base oil is modified accordingly. LC4 is then evaluated in a number of tests. The tests include high temperature high shear properties using ASTM method D4683 (result obtained: 3.16); and for cold crank properties using ASTM method D5293 at −25° C. (result obtained: 2751 $mm^2/s$). LC4 is also evaluated using Orbahn shear test (ASTM D6278). The results obtained include a final test viscosity is 9.13 $mm^2/s$, a viscosity loss (%) of 12.21, and a shear stability of 23.7.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its various embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An engine oil lubricating composition comprising:

(a) 0.075 to 8 wt % of a polymer with radial or star architecture, wherein the polymer is a polymethacrylate, or mixtures thereof; wherein the polymethacrylate is derived from a monomer composition consisting essentially of:

(i) 65 wt % to 95 wt % of an alkyl methacrylate, wherein the alkyl group of the methacrylate has 12 to 18 carbon atoms;

(ii) 5 wt % to 30 wt % of an alkyl methacrylate, wherein the alkyl group of the methacrylate has 1 to 9 carbon atoms; and (iii) 0 wt % to 10 wt % of a nitrogen containing monomer; and wherein the polymer is obtained from a RAFT or ATRP polymerisation process and the polymethacrylate polymeric arm architecture is random; and wherein the polymer has a weight average molecular weight of 300,000 to 800,000;

(b) 1 wt % to 4 wt % of an overbased detergent, wherein the overbased detergent comprises one or more of salixarates, phenates, sulphonates, or salicylates;

(c) 0.25 wt % to 15 wt % of a dispersant, wherein the dispersant comprises one or more of succinimide dispersants; and (d) an oil of lubricating viscosity, wherein the oil of lubricating viscosity is an API Group II or Group III oil or mixtures thereof;

wherein the engine oil lubricating composition provides improved viscosity while maintaining Orbahn shear.

2. The lubricating composition of claim 1, wherein the polymer contains 70 wt % or more of a mono-vinyl monomer.

3. The lubricating composition of claim 1, wherein the polymer is a copolymer.

4. The lubricating composition of claim 1, wherein the lubricating composition further comprises a portion of linear polymer chains.

5. The lubricating composition of claim 1, wherein the polymer comprises arms with random, tapered, di-block, tri-block, or multi-block architecture.

6. The lubricating composition of claim 1 further comprising an antiwear agent.

7. The lubricating composition of claim 6, wherein the antiwear agent comprises a metal dialkyldithiophosphate.

8. The lubricating composition of claim 1 further comprising an antioxidant.

9. The lubricating composition of claim 8, wherein the antioxidant is selected from the group consisting of sulphurised olefins, alkylated diphenylamines, hindered phenols, molybdenum compounds, and mixtures thereof.

10. The lubricating composition of claim 9, wherein the antioxidant is a molybdenum compound, an alkylated diphenylamine or a hindered phenol.

11. The lubricating composition of claim 1, wherein the lubricating composition has a (i) a sulphur content of 0.5 wt % or less, (ii) a phosphorus content of 0.1 wt % or less, and (iii) a sulphated ash content of 1.5 wt % or less.

12. The lubricating composition of claim 1, wherein the lubricating composition has a SAE viscosity grade from XW-Y, where X is an integer from 0 to 20 and Y is an integer from 20 to 50.

13. A method for lubricating an internal combustion engine comprising supplying to the internal combustion engine a lubricating composition, wherein the lubricating composition comprises:

(a) 0.075 to 8 wt % of a polymer with radial or star architecture, wherein the polymer is a polymethacrylate, or mixtures thereof; wherein the polymethacrylate is derived from a monomer composition consisting essentially of:

(i) 65 wt % to 95 wt % of an alkyl methacrylate, wherein the alkyl group of the methacrylate has 10 to 20 carbon atoms;

(ii) 5 wt % to 30 wt % of an alkyl methacrylate, wherein the alkyl group of the methacrylate has 1 to 9 carbon atoms; and (iii) 0 wt % to 10 wt % of a nitrogen containing monomer; and wherein the polymer is obtained from a RAFT or ATRP polymerisation process and the polymethacrylate polymeric arm architecture is random; and wherein the polymer has a weight average molecular weight of 300,000 to 800,000;

(b) 1 wt % to 4 wt % of an overbased detergent, wherein the overbased detergent comprises one or more of salixarates, phenates, sulphonates, or salicylates;

(c) 0.25 wt % to 15 wt % of a dispersant, wherein the dispersant comprises one or more of succinimide dispersants; and (d) an oil of lubricating viscosity.

14. The lubricating composition of claim 1, wherein the polymer has a weight average molecular weight of 400,000 to 800,000.

15. The lubricating composition of claim 1, wherein the polymer has 7 or more arms.

16. The lubricating composition of claim 1, wherein the polymer arms are random.

17. A method of providing improved viscosity index while maintaining Orbahn shear in an engine oil, comprising lubricating the engine with a lubricating composition comprising:

(a) 0.075 to 8 wt % of a polymer with radial or star architecture, wherein the polymer is a polymethacrylate, or mixtures thereof; wherein the polymethacrylate is derived from a monomer composition consisting essentially of:

(i) 65 wt % to 95 wt % of an alkyl methacrylate, wherein the alkyl group of the methacrylate has 12 to 18 carbon atoms;

(ii) 5 wt % to 30 wt % of an alkyl methacrylate, wherein the alkyl group of the methacrylate has 1 to 9 carbon atoms; and (iii) 0 wt % to 10 wt % of a nitrogen containing monomer; and wherein the polymer is obtained from a RAFT or ATRP polymerisation process and the polymethacrylate polymeric arm architecture is random; and wherein the polymer has a weight average molecular weight of 300,000 to 800,000;

(b) 1 wt % to 4 wt % of an overbased detergent, wherein the overbased detergent comprises one or more of salixarates, phenates, sulphonates, or salicylates;

(c) 0.25 wt % to 15 wt % of a dispersant, wherein the dispersant comprises one or more of succinimide dispersants; and (d) an oil of lubricating viscosity, wherein the oil of lubricating viscosity is an API Group II or Group III oil or mixtures thereof.

* * * * *